US006578552B2

(12) United States Patent
Boecking

(10) Patent No.: US 6,578,552 B2
(45) Date of Patent: Jun. 17, 2003

(54) HIGH PRESSURE COLLECTING CHAMBER WITH INTEGRATED PRESSURE MULTIPLICATION ELEMENT

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/054,157

(22) Filed: Nov. 13, 2001

(65) Prior Publication Data

US 2003/0024507 A1 Feb. 6, 2003

(30) Foreign Application Priority Data

Nov. 13, 2000 (DE) ..... 100 56 166

(51) Int. Cl.[7] ..... F02M 37/04
(52) U.S. Cl. ..... 123/456; 123/447
(58) Field of Search ..... 123/456, 447, 123/497

(56) References Cited

U.S. PATENT DOCUMENTS 5,806,494 A * 9/1998 Glassey ..... 123/456
6,374,806 B1 * 4/2002 Keeley et al. ..... 123/456
2002/0073969 A1 * 6/2002 Augustin ..... 123/456

FOREIGN PATENT DOCUMENTS

DE 197 01 879 A1 7/1998

* cited by examiner

*Primary Examiner*—Thomas N. Moulis
(74) *Attorney, Agent, or Firm*—Michael J. Striker

(57) ABSTRACT

A high pressure collecting chamber for receiving a fuel supply under pressure, has a piston-shaped pressure multiplication element; a line to a nozzle holder combination such that via the pressure multiplication element fuel with high pressure is available in the line; a pre-stressing element for the pressure multiplication element; a control chamber through which the pressure multiplication element is integrated, wherein the pre-stressed pressure multiplication element which is actuated via the control chamber is integrated in the high pressure collecting chamber.

9 Claims, 1 Drawing Sheet

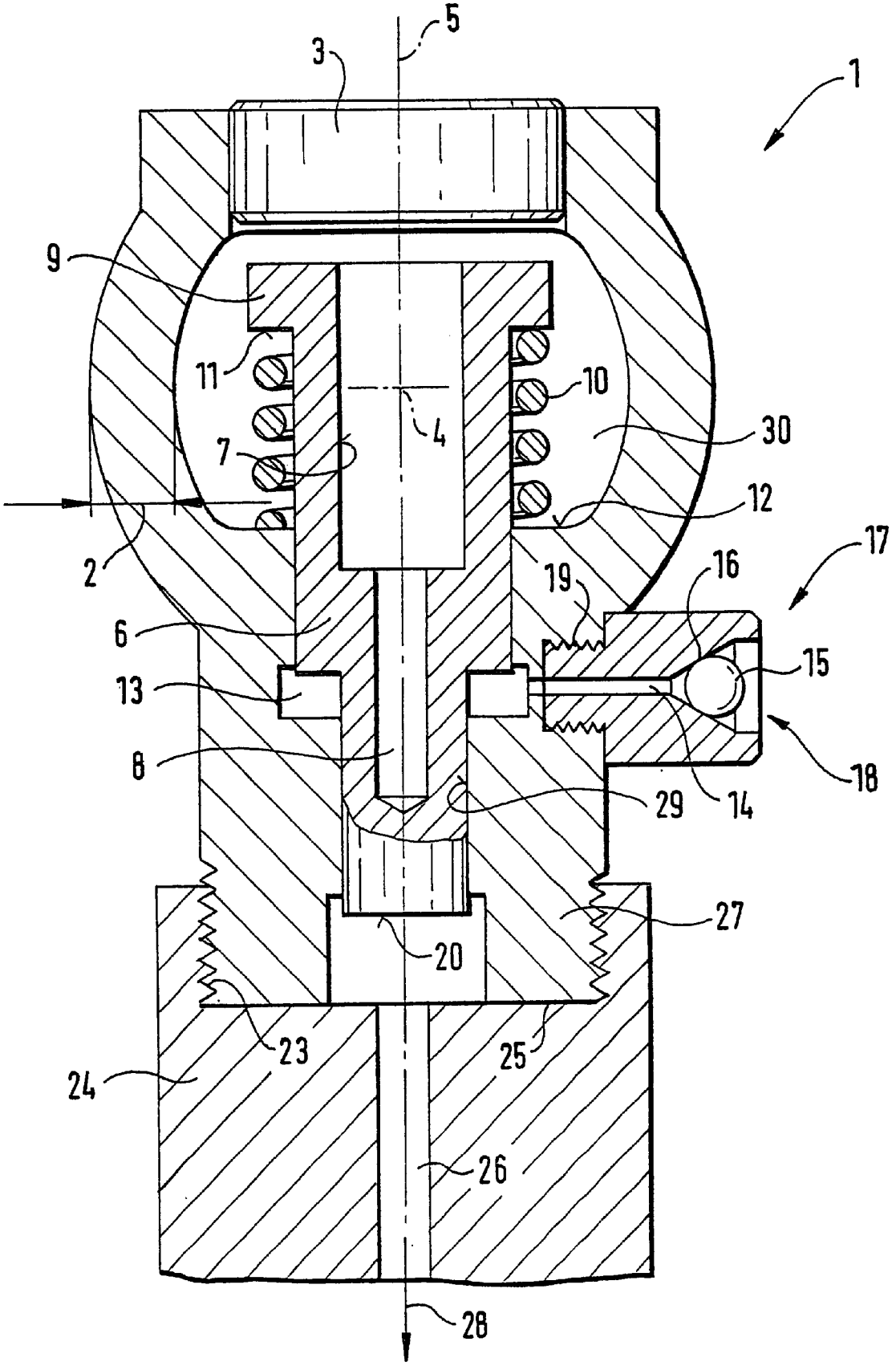
5
3
1
9
11
10
4
30
7
12
2
17
19
16
6
15
13
8
18
29
14
27
20
23
25
24
26
28

HIGH PRESSURE COLLECTING CHAMBER WITH INTEGRATED PRESSURE MULTIPLICATION ELEMENT

BACKGROUND OF THE INVENTION

The present invention relates to a high pressure collecting chamber with integrated pressure multiplication element.

In fuel injection systems with the use of direct injection internal combustion engines, high pressure collecting chambers (common rails) are utilized. The high pressure collecting chambers serve as a pressure storage for all injectors provided on a direct injection internal combustion engine, to damp pressure pulsations in the fuel injection system. The pulsations are caused on the one hand by the high pressure pump and on the other hand by opening of each injector during the injector phase in the injection system. With increased injection quantities, the pressure in the high pressure injecting chamber (common rail) remains at a high level, so that high pressure can act in the individual injectors of the internal combustion engine.

German patent document DE 197 01 879 A1 discloses a fuel injection device for internal combustion engines. The fuel injector for internal combustion engines disclosed in this reference includes a high pressure collecting chamber (common rail) jointly fillable with fuel by a high pressure pump, which is connected via injection lines with injection valves extending into the combustion chamber of the internal combustion engine to be supplied. The opening and closing movements of the injection valves are controlled each by an electrically-controlled control valve, wherein the control valve can be formed as a 3/2-way valve, which connects a high pressure passage open into an injection opening of the injection valve, with the injection line or a release line. A hydraulic working chamber which is fillable with fuel under high pressure is provided at the control valve member of the control valve. It is controllable for adjusting the adjusted positions of the control valve member in a release passage.

Monosystems which are used in injection systems have the disadvantage that only a small volume is available at the low pressure side for damping pressure pulsations. Thereby pressure vibrations at the low pressure side can act strongly on the total hydraulic system. With low volumes, the pressure pulsations are critical and it is possible that the required high pressure at the beginning of the injection can not be reached.

SUMMARY OF THE INVENTION

Accordingly, it is an object of the present invention to provide a high pressure collecting chamber with integrated pressure multiplication element.

In keeping with these objects and with others which will become apparent hereinafter, one feature of present invention resides, briefly stated, in a high pressure collecting chamber for receiving a fuel supply under pressure, comprising a piston-shaped pressure multiplication element; means forming a line to a nozzle holder combination such that, via the pressure multiplication element, fuel with high pressure is available in the line; means for pre-stressing the pressure multiplication element; a control chamber through which the pressure multiplication element is integrated; and means limiting the high pressure collecting chamber, the pre-stressed pressure multiplication element which is actuated via the control chamber being integrated in the means forming the high pressure collecting chamber.

With the inventive solution, the action of pressure pulsations is reduced by withdrawing a great a damping volume for reduction of pressure pulsations. Since in the high pressure collecting chamber always a greater fuel quantity is available when compared with that in the individual injector, these volumes can be used as damping volumes for pressure pulsation.

The injector can be integrated in a space-economical way in the high pressure collecting chamber, and at the lower side of the high pressure collecting chamber the surfaces can be provided on which the nozzle holding bodies can be fixed.

Depending on the configuration of the high pressure collecting chamber, by means of the modular principle a change can be provided, with which connecting flanges can be formed for each cylinder no. 4, 6, 8, of which however only a few are utilized when the mounting space for the high pressure collecting chamber is sufficient.

Depending on the design and mounting variants on motor vehicles, identical parts can be utilized and they can be adjusted to individual requirements because of extensions to be mounted. Modifications of the existing systems are not a problem with the use of the modular system.

With the selected solution, the amplitudes of the pressure pulsations can be hold lower at the low pressure side. Further, by an integration of a multiplication piston in the high pressure collecting chamber, valuable space in the region of the cylinder head of an internal combustion engine is saved. The shorter the power lines can be held, the lower the friction forces in the system, the shorter are the response times due to the reduced fluid volumes to be moved.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The single FIGURE of the drawings is a view showing a section through a multiplication piston integrated in a high pressure collecting chamber, wherein a nozzle holder combination is placed on the lower side of the high pressure collecting chamber.

DESCRIPTION OF THE PREFERRED EMBODIMENTS

A high pressure collecting chamber 1 as shown in FIG. 1 extends in an upper region substantially symmetrical to its axis 4. Individual pressure conversion or multiplication elements 6 can be integrated in its wall 2 at a certain distances from one another. At the upper side of the high pressure collecting chamber 1 (common rail) it can be closed by a closure 3 which simultaneously allows an access to inserts located inside the high pressure collecting chamber 1. In the section shown in FIG. 1 the cross-section extends directly through the high pressure collecting chamber 1 in a region in which a piston-shaped pressure multiplication element 6 is vertically guided rotation-symmetrically to the axis of symmetry 5.

The piston-shaped pressure conversion or multiplication element 6 which is movable vertically upwardly and downwardly in the vertical direction inside a support region 27 of the high pressure collecting chamber 1 is provided at its upper side with a disc-shaped support surface 9. It serves as a support surface for a spring element 10 which surrounds the piston-shaped pressure multiplication element 6 in its upper diameter region. The spring element 10 preferably is formed as a spiral spring. It is supported at an inner side of the wall 2 of the high pressure collecting chamber 1 in the region of an abutment surface 12 and pre-tensions the piston-like pressure multiplication element 6 inside the high pressure collecting chamber 1. An opening 7 is provided in the upper region of the piston-shaped pressure multiplication element 6. A vertically downwardly extending opening 8 extends from the opening 7. A lower diameter portion is connected to the upper diameter portion of the piston-shaped pressure multiplication element 6. The opening in the support 27 of the high pressure collecting chamber 1 represents a lower guiding surface 29 for the piston-shaped pressure multiplication element 6 which is movable vertically upwardly and downwardly in the support 27 of the high pressure collecting chamber 1.

A control chamber 13 is limited in the housing of the high pressure collecting chamber 1 between the upper diameter region of the piston-shaped pressure multiplication element 6 and its lower diameter region. The control chamber 13 is pressure unloaded by a control module 18 which is laterally flanged on the support 27 of the high pressure collecting chamber 1. The control module 18 includes an opening which opens into the ring-shaped control chamber 13 in the support 27 of the high pressure collecting chamber 1. A discharge opening 14 of the control chamber 13 is closed and opened by a ball-shaped closing element 15. When an actuator 17 is supplied with power, the ball-shaped closing element 15 is pressed either to its seat surface 16 in the control module 18 or is withdrawn from it.

The actuator 17 can be formed as a magnetic valve, and also as a piezo actuator or piezo adjuster. In additional, also mechanical/hydraulic multipliers are suitable which pass the pressure changes in the control chamber 13 under the upper diameter region of the piston-shaped pressure multiplication element 6.

In the embodiment shown in FIG. 1 the control module 18 is screwed by a thread 19 in the support 27 of the high pressure collecting chamber and sealingly connected with it.

An end surface 20 is located at the lower end of the piston-shaped pressure multiplier 6. It represents simultaneously the limiting surface of a high pressure chamber 21 which is formed in the support 27 of the high pressure collecting chamber 1. The end surface 20 of the piston-shaped pressure multiplier 6 substantially corresponds to the diameter of the high pressure chamber 21 in the support 27 of the high pressure collecting chamber 21. The high pressure chamber 21 is positioned in the support 27 of the high pressure collecting chamber 1, so that a line 26 to an injection nozzle inside the nozzle needle combination 33 is located directly opposite to it. In the region of the separation joint 25 in the support 27 of the high pressure collecting chamber 1 and the threaded region of the nozzle holder combination 23, the both components are connected with one another by a union nut 24. For this purpose a thread is provided on the outer side of the support 27. It is located on the upper side of the nozzle holder combination 22 and identified there with reference numeral 22. The support 27 of the high pressure collecting chamber 1 as well as the inlet region of the nozzle holder combination 23 are sealingly connected with one another by the union nut 24 which is formed as a nut. No leakage losses can occur along the separating joint 26 between the both above mentioned components, so that fuel which is under high pressure in the high pressure chamber 21 follows in the flow direction 28 into the line 26, which leads to a not shown injection nozzle.

Reference numeral 30 identifies the low pressure side of the high pressure collecting chamber, in which the piston-shaped pressure multiplication element 6 extends rotation-symmetrically to the axis of symmetry 5. The pressure multiplication element 6 is guided with its greater diameter region in the wall 2 of the high pressure collecting chamber 1. The piston-shaped multiplication element 7 has a portion with a smaller diameter which is guided along a guiding surface 29 in an opening in the support 27 of the high pressure chamber 21.

With the inventive solution the piston-shaped multiplication element 6 can be placed on the control pressure side in the high pressure collecting chamber so that the occurring pressure pulsations can be damped efficiently by high fuel volumes available in the high pressure collecting chamber and can not propagate into the line 26 of the not shown injection nozzle.

In a preferable embodiment, the high pressure collecting chamber 1 is formed in accordance with a modular principle, so that depending on the required injector number 4, 6, 8, or 12, different numbers of support-shaped connecting elements 27 provided with outer thread are located in the flange region of the high pressure collecting chamber, which can be connected by a union nut 24 with the nozzle holder combination 23. Thereby leakages at the separation joint 25 can be efficiently avoided. The integration of the piston-shaped pressure multiplication element 6 into the interior of the high pressure collecting chamber 1 provides a small structural height of the inventive injector configuration. Therefore shorter lines can be provided and lower fuel volumes can be supplied through shorter lines, to provide shorter response times.

It will be understood that each of the elements described above, or two or more together, may also find a useful application in other types of constructions differing from the types described above.

While the invention has been illustrated and described as embodied in high pressure collecting chamber with integrated pressure multiplication element, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A high pressure collecting chamber for receiving a fuel supply under pressure, comprising a piston-shaped pressure multiplication element; means forming a line to a nozzle holder combination such that via said pressure multiplication element fuel with high pressure is available in said line; means for pre-stressing said pressure multiplication element; a control chamber through which said pressure multiplication element is integrated; and means limiting the high pressure collecting chamber, said pre-stressed pressure multiplication element which is actuated via said control chamber being integrated in said means forming the high pressure collecting chamber.

2. A high pressure collecting chamber as defined in claim 1; and further comprising a control module mounted on said means forming a high pressure collecting chamber, said control chamber being pressure regulatable via said control module.

3. A high pressure collecting chamber as defined in claim 1, wherein said pre-stress pressure multiplication element is subdivided into two diameter regions which limit said control chamber.

4. A high pressure collecting chamber as defined in claim 1, wherein said means forming the high pressure collecting chamber has an upper and a lower guiding portion, said pre-stressed pressure multiplication element being guided in said upper and lower guiding portions.

5. A high pressure collecting chamber as defined in claim 1, wherein said means forming the high pressure collecting chamber have an end side provided with a flange in which a high pressure chamber is formed, said pressure chamber being located opposite to said line which leads to the nozzle holder combination.

6. A high pressure collecting chamber as defined in claim 5, wherein said flange and said nozzle holder combination are sealingly connected with one another at their separating joint; and further comprising means for sealingly connecting said flange and said nozzle holder combination with one another.

7. A high pressure collecting chamber as defined in claim 6, wherein said connecting means include a union nut.

8. A high pressure collecting chamber as defined in claim 1; and further comprising a spring element which surrounds said piston-shaped pressure multiplier and pre-stress the latter, said means forming the high pressure collecting chamber having an inner wall provided with an abutment surface and an abutment, said spring element being supported on said abutment surface and said abutment.

9. A high pressure collecting chamber as defined in claim 5, wherein said high pressure chamber has a limiting wall which forms an end surface of said piston-shaped multiplication element, said end surface being formed in a diameter of said high pressure chamber.

* * * * *